US007643908B2

(12) United States Patent
Quirino et al.

(10) Patent No.: US 7,643,908 B2
(45) Date of Patent: Jan. 5, 2010

(54) OCCUPANT CONTROLLED ENERGY MANAGEMENT SYSTEM AND METHOD FOR MANAGING ENERGY CONSUMPTION IN A MULTI-UNIT BUILDING

(75) Inventors: Richard N. Quirino, East Lyme, CT (US); Gregory F. Schuerer, Mystic, CT (US); Philipp A. Roosli, Niantic, CT (US); Duane W. Buckingham, Old Lyme, CT (US)

(73) Assignee: Inncom International Inc., Niantic, CT (US)

( * ) Notice: Subject to any disclaimer, the term of this patent is extended or adjusted under 35 U.S.C. 154(b) by 0 days.

(21) Appl. No.: 12/274,431

(22) Filed: Nov. 20, 2008

(65) Prior Publication Data

US 2009/0065598 A1 Mar. 12, 2009

Related U.S. Application Data

(63) Continuation of application No. 11/749,321, filed on May 16, 2007.

(51) Int. Cl.
*G05D 5/00* (2006.01)
*G05D 9/00* (2006.01)
*G05D 17/00* (2006.01)

(52) U.S. Cl. ..... 700/277; 700/275; 700/276; 700/299; 715/700; 165/237; 165/238; 165/239; 236/49.3; 236/91 D; 236/91 F; 236/94

(58) Field of Classification Search ..... 165/11.1, 165/200, 201, 237, 257; 236/46 R, 47, 49.1, 236/49.3, 51, 91 R, 91 C–91 F, 94; 340/310.11, 340/310.16, 500, 540, 691.1, 691.4, 691.5, 340/693.3, 870.02; 700/83, 275–278, 291, 700/299, 300, 295, 296; 715/700; 705/412, 705/418; 702/57, 60–62
See application file for complete search history.

(56) References Cited

U.S. PATENT DOCUMENTS 4,060,123 A * 11/1977 Hoffman et al. ..... 165/11.1

(Continued)

FOREIGN PATENT DOCUMENTS

JP 05-157255 6/1993

(Continued)

OTHER PUBLICATIONS

Control4 Suite Systems, Redefining the Guest Experience; Control4 Everyday Easy; Informational Brochure; Control4 11734 S. Election Road, Salt Lake City, Utah 84020 control4.com/suitesystems; Copyright 2006; 6 pages.

*Primary Examiner*—Michael D Masinick
(74) *Attorney, Agent, or Firm*—Cantor Colburn LLP

(57) ABSTRACT

A system is provided for use in a multi-unit building by which an occupant of a unit of the multi-unit building controls an appliance associated with the unit and includes an actuator which is accessible to the occupant, a processing unit to control the appliance, operative in the first mode, based on occupant instructions, to change the mode of the appliance based on an actuation of the actuator and to control the appliance, operative in the second mode, according to a preselected schedule, and a networking unit to inform, via communications, a monitor of the multi-unit building as to when the appliance operates in the second mode.

9 Claims, 7 Drawing Sheets

U.S. PATENT DOCUMENTS 4,429,299 A * 1/1984 Kabat et al. ..... 340/310.16
4,637,223 A 1/1987 Hosoya et al.
5,305,952 A * 4/1994 Hannarong ..... 236/47
5,344,068 A * 9/1994 Haessig ..... 236/47
5,572,438 A * 11/1996 Ehlers et al. ..... 700/295
5,761,083 A * 6/1998 Brown et al. ..... 700/296
5,833,134 A * 11/1998 Ho et al. ..... 236/49.3
5,850,753 A * 12/1998 Varma ..... 70/278.7
5,909,378 A * 6/1999 De Milleville ..... 700/276
6,260,765 B1 * 7/2001 Natale et al. ..... 236/47
6,349,883 B1 * 2/2002 Simmons et al. ..... 236/46 R
6,785,592 B1 * 8/2004 Smith et al. ..... 700/291
7,061,393 B2 * 6/2006 Buckingham et al. .... 340/693.3
7,280,893 B2 * 10/2007 Spool et al. ..... 700/291
7,417,397 B2 * 8/2008 Berman et al. ..... 318/468
7,432,477 B2 10/2008 Teti
7,541,941 B2 * 6/2009 Bogolea et al. ..... 340/870.02
7,561,977 B2 * 7/2009 Horst et al. ..... 702/62
2005/0194456 A1 * 9/2005 Tessier et al. ..... 236/51
2006/0106499 A1 * 5/2006 Roosli et al. ..... 700/276
2007/0114293 A1 5/2007 Gugenheim
2007/0203860 A1 * 8/2007 Golden et al. ..... 705/412
2007/0210177 A1 * 9/2007 Karasek ..... 236/46 R
2007/0255457 A1 * 11/2007 Whitcomb et al. ..... 700/273
2007/0267508 A1 * 11/2007 Hoglund et al. ..... 236/49.1
2008/0005044 A1 * 1/2008 Benya et al. ..... 705/412
2008/0236177 A1 * 10/2008 Senba et al. ..... 62/157
2009/0088991 A1 * 4/2009 Brzezowski et al. ..... 702/62

FOREIGN PATENT DOCUMENTS

KR 1020000009359 A 2/2000
KR 1020030009916 A 2/2003
KR 1020030052292 A 6/2003
KR 1020030055738 A 7/2003

* cited by examiner

OCCUPANT CONTROLLED ENERGY MANAGEMENT SYSTEM AND METHOD FOR MANAGING ENERGY CONSUMPTION IN A MULTI-UNIT BUILDING

CROSS REFERENCE TO RELATED APPLICATIONS

This application is a continuation of and claims the benefit of priority to U.S. patent application Ser. No. 11/749,321, the entire contents of which are incorporated herein by reference.

FIELD OF THE INVENTION

The disclosure relates generally to an energy management system for a multi-unit building, and more particularly to an occupant controlled energy management system for an individual unit of the building.

BACKGROUND OF THE INVENTION

Over the last couple of decades, the world population has become increasingly aware of the threat of global warming, and the impact it may have on our planet. In response to this awareness, individuals have become more conscious of their personal "carbon footprint," and have looked for ways to minimize their individual negative effects on the environment. It has been well established that these effects can be reduced by decreasing carbon-based energy or power consumption associated with, for example, transportation, industry, and also the occupation and usage of various buildings and residences.

Multi-unit buildings, such as hotels, motels, inns, dormitories, offices, etc., typically require significant carbon-based energy consumption in order to provide for the needs of their occupants. This energy consumption is associated primarily with heating, ventilation, and air conditioning (herein, "HVAC"), lighting, and other appliance operation (e.g., television, computers, etc.). In these multi-unit buildings it can be difficult for management to set building-wide reduced energy consumption parameters for the HVAC and/or various appliances because not all of the building occupants may find comfort and/or convenience at such settings.

Some multi-unit buildings, particularly in the lodging industry, provide an occupant accessible thermostat in each of the rooms of the building. Some of these thermostats include controls by which the occupant may adjust HVAC operation to attain a desired room temperature. However, without prior knowledge of the specifications of the particular multi-unit building, it is not possible for the occupant to set the thermostat to maximize energy conservation in the room. Moreover, these existing thermostats do not typically provide for adjustment or regulation of other in-room energy consuming appliances such as lighting, etc. Thus, convenient in-room occupant controlled energy conservation within a multi-unit building is not possible.

Accordingly, a temperature/appliance management system capable of allowing an individual occupant of a multi-unit building to conveniently set and maintain room conditions at a level that is both comfortable and minimally consumptive of power would be desirable.

SUMMARY OF THE INVENTION

A system is generally described herein for allowing an occupant of a single unit of a multi-unit building to select an operating state of the unit which consumes less energy than a normal operating state.

The invention provides an occupant controlled energy management system for a unit of a multi-unit building, the system including at least one appliance disposed in the unit and configured to effect a change in a condition within the unit, and an appliance control device in operable communication with the at least one appliance, the appliance control device being accessible to an occupant of the unit, where the appliance control device is configured to include an energy conserving setting that limits energy consumption by the at least one appliance, and wherein the energy conserving setting is actuatable by the occupant by one touch of an actuator disposed on the appliance control device.

The invention further provides a method for managing energy in a multi-unit building, the method including providing an appliance control device in an area accessible to an occupant of a unit of the building, operably connecting the appliance control device, by any wired or wireless means, with at least one appliance disposed to effect a change in a condition within the unit, configuring the appliance control device to include an energy conserving setting that limits energy consumption by the at least one appliance, and implementing the energy conserving setting within the unit upon the occupant's actuation of the an actuator disposed on the appliance control device.

The invention also provides a method of operating or managing a multi-unit building, including informing an occupant upon arrival at the multi-unit building of an environmental effect of an occupant controlled energy management system provided in each unit of the building, encouraging the occupant to select an energy conservation setting of the energy management system by maneuvering an actuator disposed in the unit, providing reduced energy consumption within the unit upon the occupant's actuation of the actuator, and optionally providing further information and/or benefits to the occupant having selected and utilized the reduced energy consumption setting.

In accordance with another aspect of the invention, a system is provided for use in a multi-unit building by which an occupant of a unit of the multi-unit building controls an appliance associated with the unit and includes an actuator which is accessible to the occupant, a processing unit to control the appliance, operative in the first mode, based on occupant instructions, to change the mode of the appliance based on an actuation of the actuator and to control the appliance, operative in the second mode, according to a preselected schedule, a networking unit to inform, via communications, a monitor of the multi-unit building as to when the appliance operates in the second mode, and an exterior indicator, external from the unit and coupled to the monitor, which activates in response to the communications and thereby instructs managing staff of the multi-unit building to modify service to the occupant.

In accordance with another aspect of the invention, a system is provided for use in a multi-unit building by which an occupant of a unit of the multi-unit building controls an appliance associated with the unit and includes an actuator which is accessible to the occupant, a processing unit to control the appliance, operative in the first mode, based on occupant instructions, to change the mode of the appliance based on an actuation of the actuator and to control the appliance, operative in the second mode, according to a preselected schedule, a networking unit to transmit a signal that is reflective of the appliance operating in the second mode, and a monitor of the multi-unit building to receive the signal transmitted by the networking unit, the monitor being configured to calculate a total time during which the appliance operates in the second mode and to provide for compensation directed to the occupant in accordance with the calculated total time.

In accordance with yet another aspect of the invention, a system is provided for use in a multi-unit building by which an occupant of a unit of the multi-unit building controls an appliance associated with the unit and includes an actuator which is accessible to the occupant, a processing unit to control the appliance, operative in the first mode, based on occupant instructions, to change the mode of the appliance based on an actuation of the actuator and to control the appliance, operative in the second mode, according to a preselected schedule, and a networking unit to inform, via communications, a monitor of the multi-unit building as to when the appliance operates in the first or the second mode.

BRIEF DESCRIPTION OF THE FIGURES

The following descriptions should not be considered limiting in any way. With reference to the accompanying drawings, like elements are numbered alike.

DETAILED DESCRIPTION

Figure 1:
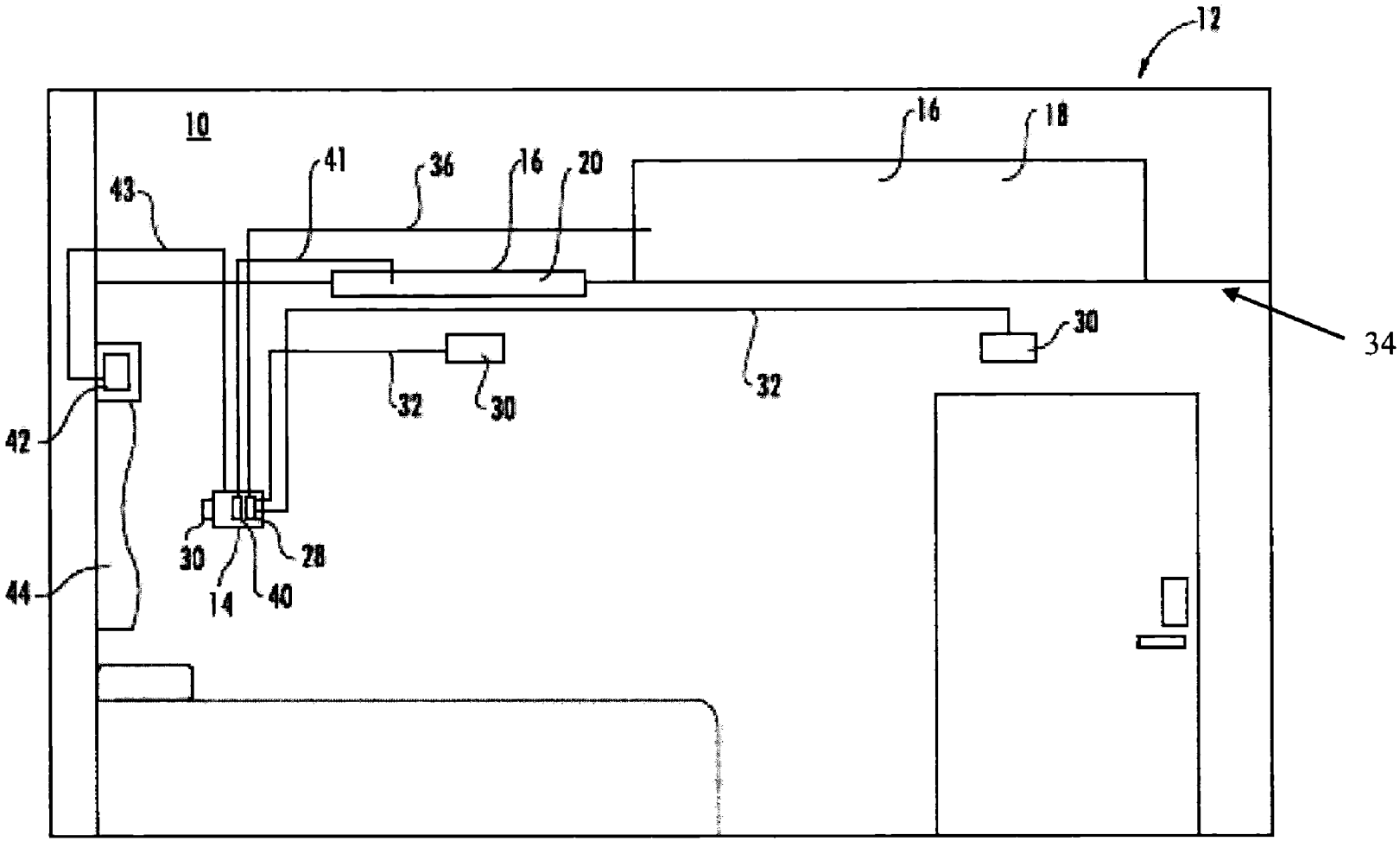
FIG. 1 is a schematic representation of a unit of a multi-unit building where the unit includes an occupant controlled energy management system.

FIG. 1 shows an exemplary individual unit or room 10 of a multi-unit building including an occupant controlled energy management system 12. The system 12 includes a room appliance control device 14 that is accessible to an occupant of the room 10 and which is operably communicated with at least one appliance 16. The appliances 16 illustrated in the exemplary embodiment of FIG. 1 include a heating, ventilation, and air conditioning (HVAC) unit 18 and a lighting system 20. However, it should be appreciated that any appliance (such as a TV, VCR, stereo, phone, computer, or DVD player) used in an individual unit of a multi-unit building may be associated with the system 12. These appliances 16 are configured and disposed within the room 10 so as to be capable of effecting a change in condition (such as a change in temperature and lighting conditions) within the unit 10.

Figure 2:
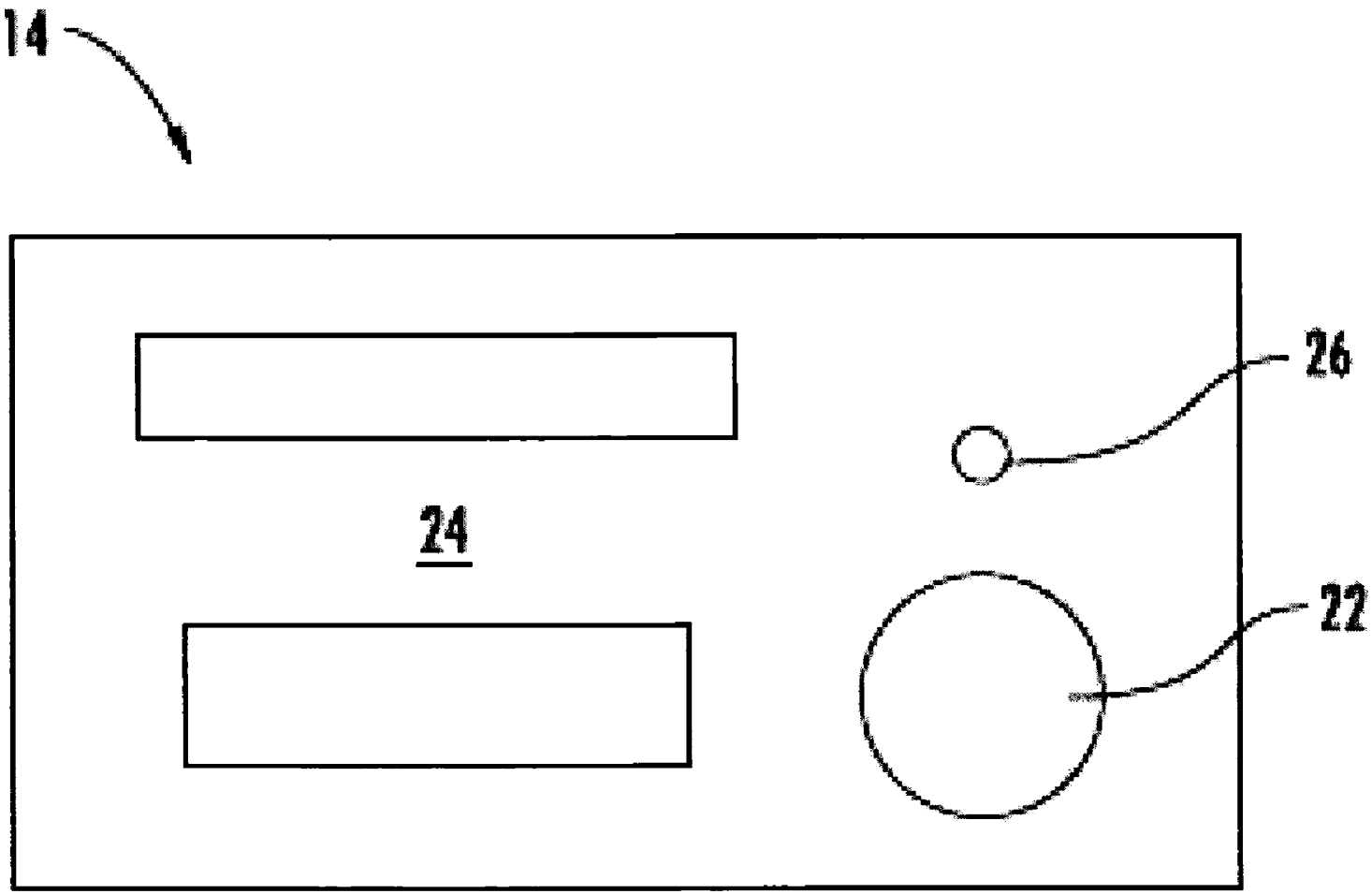
FIG. 2 is a schematic representation of an appliance control device of the occupant controlled energy management system of FIG. 1.

The appliance control device 14 is configured to include an energy conserving setting that limits energy consumption by one or more of the appliances 16. As is shown in FIG. 2, the unit occupant activates the energy conserving setting via an actuator 22 disposed on a surface 24 of the appliance control device 14. In the exemplary embodiment of FIG. 2, this actuator 22 is a button that may be a shade of green in order to indicate the reduced energy consumption setting and also, generally, environmental awareness. The green button 22 need only be depressed once to activate the energy conserving setting. Activation of the energy conserving setting is indicated to the occupant via an indicator 26 that is also disposed on the surface 24 of the appliance control device 14. This indicator 26 may be a light emitting diode (LED) arrangement and may additionally be a shade of green.

In an alternative embodiment, data relating to the energy conserving setting can be stored in the appliance 16. In this case, the appliance control device 14 simply informs the appliance 16 as to which of the energy conserving setting or the normal setting should be activated.

The energy conserving setting is simply an operating mode of the respective appliance 16 during which the appliance 16 consumes less energy than when operating under another reference operating mode. The reference operating mode may be, for example, a normal operating mode during which the appliance 16 takes no energy conservation measures. Alternatively, in the reference mode, the appliance 16 may operate in a manner to conserve energy, but to a lesser extent than when operating under the energy conserving setting Of course, the button configuration of the actuator 22 discussed herein is merely exemplary. The actuator 22 may comprise a dial, switch, knob, touch pad, or any mechanism or means suitable for communicating the desired reduced energy setting to the appliance control device 14. Similarly, in addition to or alternatively from the LED, the indicator 26 may comprise an auditory signal, such as a chime, or may comprise a green portion of the surface 24 of the control device 14 made visible by maneuvering the actuator 22, etc. The indicator 26 is shown by way of example in FIG. 2 as being disposed on the surface 24 of the control device 14 in a position adjacent to the actuator 22. In another embodiment, the indicator 26 may form a part of the actuator 22. That is, the indicator 26 may be disposed upon or within the actuator 22. For example, the indicator 26 may comprise an LED (or similar lighting means) which is located within the green button actuator 22 such that when the button is pressed, it becomes illuminated in a green color.

Figure 3:
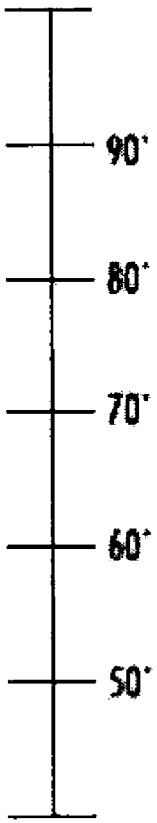
FIG. 3 is a graph illustrating a temperature range.

Referring again to FIG. 1, the appliance control device 14 includes a temperature control device 28. This temperature control device 28 is operably communicated with the HVAC 18 introduced above. The temperature control device 28 is configured to place the HVAC 18 into an energy conserving setting when the occupant maneuvers the actuator 22. This energy conserving setting results in the HVAC 18 producing a room temperature range which is both comfortable for the occupant and less consumptive of energy than normal operating conditions. In an exemplary embodiment, this temperature range is delimited by a high temperature of 80 degrees and a low temperature of 60 degree Fahrenheit (as shown in the graph of FIG. 3), though other ranges may be used, e.g., 50 to 90 degrees Fahrenheit.

The temperature control device 28 is also operably in communication with one or more temperature sensors 30 disposed on and/or about the control device 14, and configured to sense temperature conditions (i.e. unit temperature) within the unit 10. Once sensed, the sensor 30 transmits temperature data to the temperature control device 28. These sensors 30 may be any suitable temperature sensor known in the art and may communicate with the temperature control device 14 via any wireless/non-wireless means 32, such as cabling, IR transceivers, or RF transceivers.

Essentially, when the actuator 22 is maneuvered, the temperature control device 28 places the HVAC 18 into an offset mode in which the temperature of the room is allowed to move naturally within the predetermined temperature range (e.g., 68 F-76 F). If the room temperature wanders outside of this range, the HVAC 18 is activated in order to return the temperature to within the range.

In other words, when the energy conserving setting is activated and the temperature control device 28 receives temperature data from the sensors 30 indicating that the room temperature is above the high end of the temperature range, the temperature control device 28 will signal the HVAC 18 to only lower the room temperature to the acceptable, high temperature of 76° F., and no lower. Similarly, when the temperature control device 28 receives temperature data from the sensors 30 indicating that the room temperature is below the low temperature, the temperature control device 28 will signal the HVAC 18 to only raise the unit temperature to the acceptable, low temperature of 68° F., and no higher. In addition, when the temperature control device 28 receives temperature data from the sensors 30 indicating that the room temperature is within the acceptable temperature range, the temperature control device 28 will shut down the HVAC 18 until the unit reaches either the high temperature or the low temperature. With the HVAC 18 shut down, once the room temperature reaches either the high temperature or low temperature, the temperature control device signals the temperature actuator to re-start, and maintain the room temperature at whichever of the high or low temperature the unit temperature reaches.

By controlling the room temperature in the above described manner, the occupant is able to maintain a prescribed temperature comfort level while conserving energy.

It should be appreciated that the temperature control device 28, and the appliance control device 14 in general, are preferably included within a thermostat disposed within the room 10. It should also be appreciated that the HVAC 18 may include a Fan Coil Unit (FCU), a Packaged Terminal Air Conditioner (PTAC) or other Heating, Ventilation, and Air Conditioning system components. The Packaged Terminal Air Conditioner (PTAC) is an air conditioner/heater unit that extends through an exterior wall of the building. The Fan Coil Unit (FCU) controls ventilation for heating and cooling the room.

The system 12 may also include or be associable with an Energy Management System (EMS) device, a Direct Digital Control (DDC) system device, and/or other electronic devices typically found in rooms or units of a multi-unit building. If present, the Energy Management System (EMS) device is a component in the system 12 that allows digital control of the appliance control device 14. One example of an EMS is the e$^4$™ Energy Management System commercially available from Inncom International, Inc. of Niantic, Conn. A direct digital control (DDC) system device is a component that allows an occupant to remotely control devices or appliances such as the system 12, wherein the energy conserving setting may be activated via a button on a remote control that is in communication with the appliance control device 14.

As is also shown in the exemplary embodiment of FIG. 1, the appliance control device 14 is accessible to the occupant of the room 10, and the HVAC 18 is disposed in a ceiling 34 of the room 10, so as to be capable of actuating temperature change in the unit 10 (i.e. through a vent). The temperature control device 28 of the appliance control device 14 is in operable communication with the HVAC 18 via a connection 36, such as wiring, infrared or RF transceivers, or other wireless communication devices. The HVAC 18 includes additional venting and ducting as needed.

As is mentioned above, the appliance control device 14 may optionally be operably communicated with the lighting system 20 of the room 10. In this embodiment, the appliance control device 14 controls the lighting system 20 via a lighting control device 40 included therewithin. The lighting control device 40 portion of the appliance control device 14 is in operable communication with the lighting system 20 via a lighting connection 41, such as wiring, infrared or RF transceivers, or other wired or wireless communication devices. The light control device 40 is configured to reduce lighting in the room 10 to a pre-determined illumination level when the energy conserving setting is activated at the appliance control device 14. This reduced lighting may include a complete shut down/deactivation and/or dimming of all, some, or one of the lights in the unit 10. In one embodiment the reduced lighting affected by actuation of the actuator 22 may comprise a time-out period for turning off lights when the particular room goes unoccupied for a designated time period. Here, the room further includes an occupant sensor which detects the presence of a person in the room and communicates such to the control device 16 and/or to a building network (as discussed further herein). When the actuator 22 is selected by the occupant, the sensor monitors the room and signals the control device 14 to shut off or dim some or all of the room lights after a predetermined period of non-occupancy (e.g., five minutes). Alternatively, actuation of the actuator 22 may reduce a previously established time-out period. For example, maneuvering the actuator may change the room lighting time-out period from five minutes to two minutes. By automatically reducing lighting in these various manners, the unit occupant conserves energy consumption.

Figure 4:
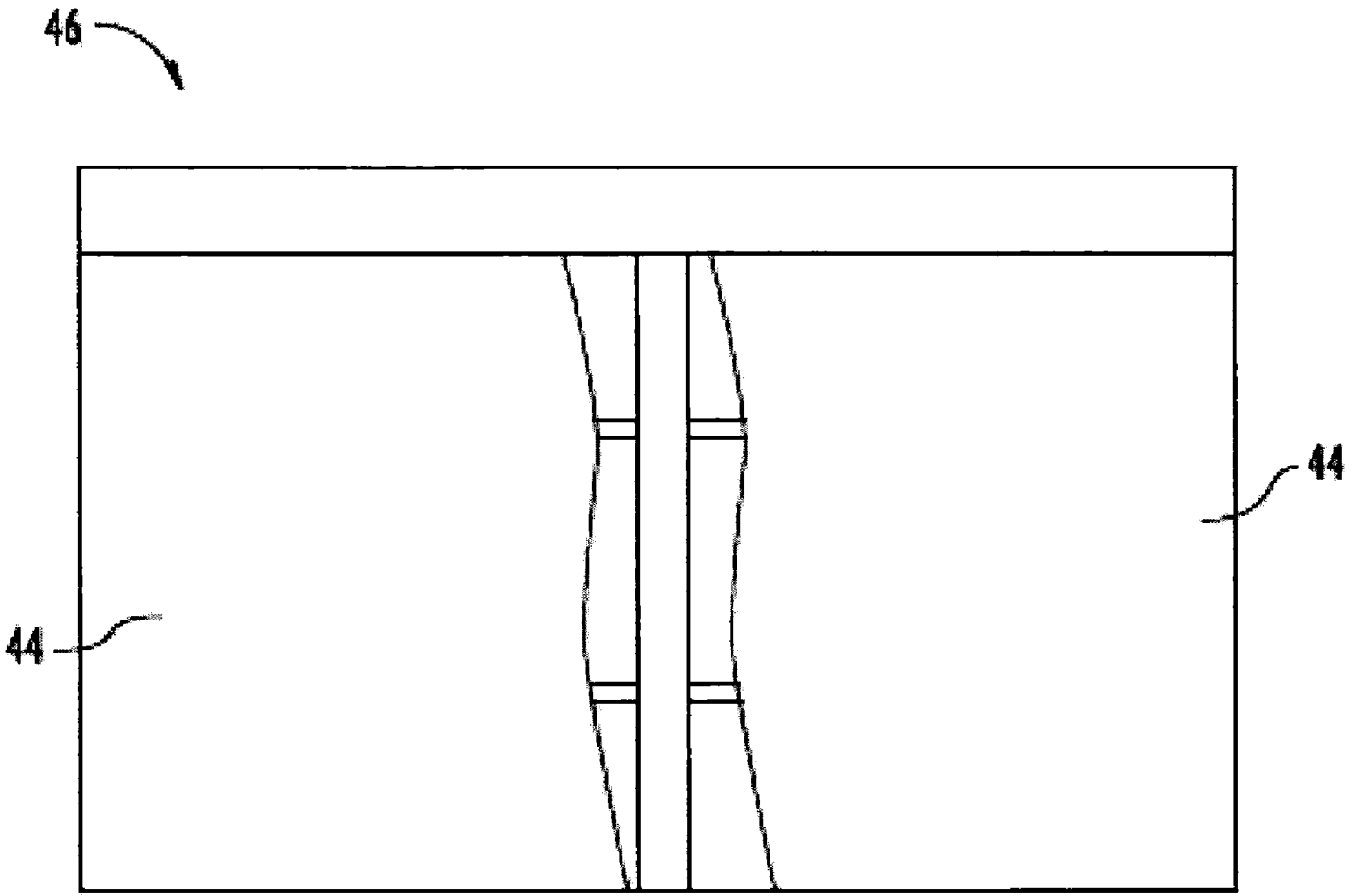
FIG. 4 is a schematic representation of a covering means of the occupant controlled energy management system of FIG. 1; the covering means being illustrated in a light blocking position.
Figure 5:
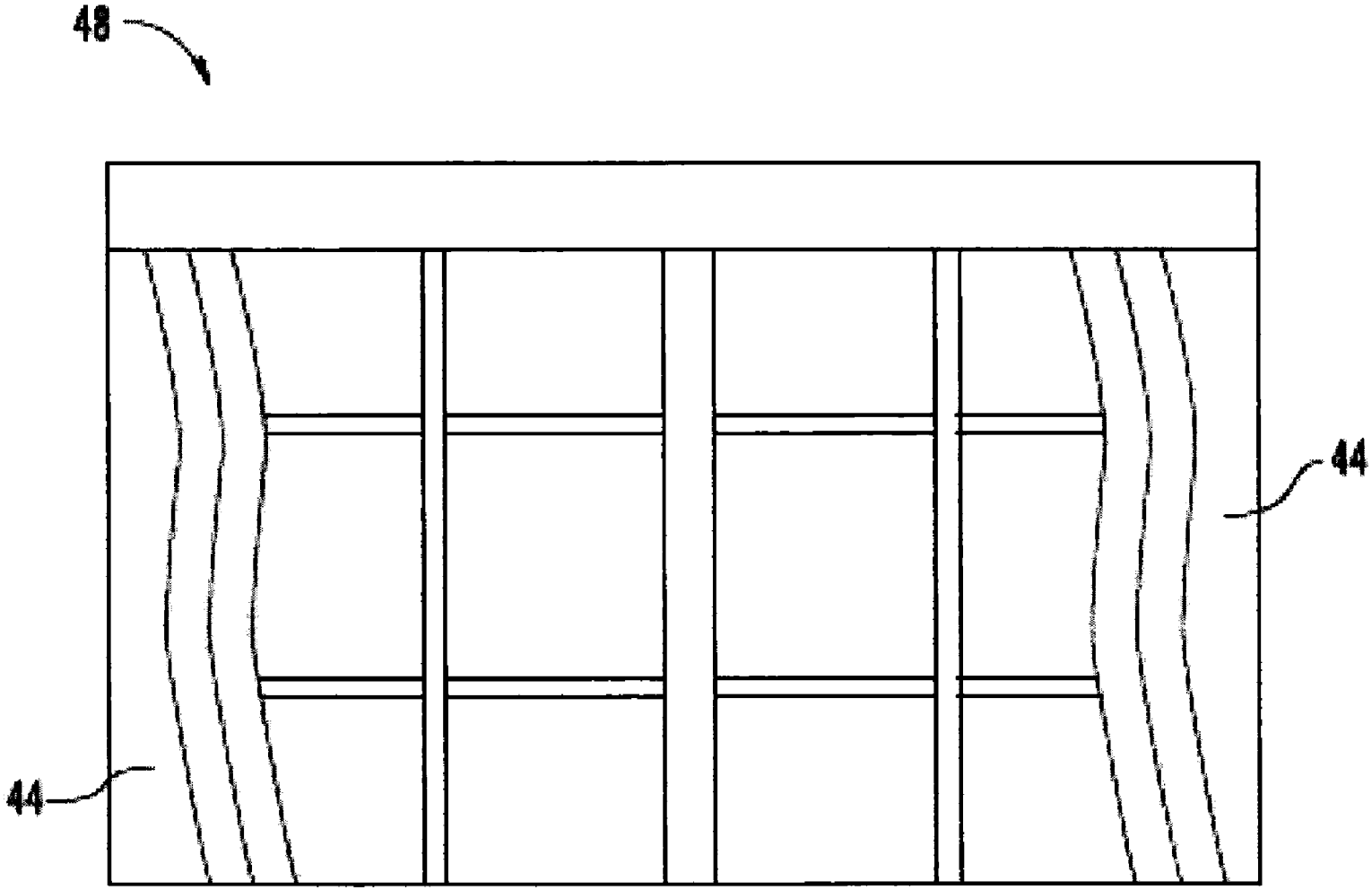
FIG. 5 is a schematic representation of a covering means of the occupant controlled energy management system of FIG. 1; the covering means being illustrated in a light entering position.

Additionally and/or alternatively, the appliance control device 14 may also be operably communicated with an automated shade or other window treatment control device 42. The automated shade control device 42 controls a window covering mechanism 44 (such as blinds, shades, curtains, automatic window tinting, etc.) for at least one window 44 in the room 10. The appliance control device 14 is in operable communication with the automated shade control device 42 via shade connection 43, such as wiring, infrared or RF transceivers, or other wired or wireless communication devices. The covering mechanism 44 is disposable between a light blocking position 46 and light entering position 48, as shown in FIGS. 4 and 5. The appliance control device 14 is configured to signal the automated shade control device 42 to move the covering mechanism during daytime hours into the light blocking position 46 when the unit is above the high temperature (of the acceptable temperature range discussed above) and the energy conserving setting is activated. Similarly, the appliance control device 14 is also configured to signal the automated shade control device 42 to move the covering mechanism 42 into the light entering position 48 during daylight hours when the room 10 is below the low temperature (of the acceptable temperature range discussed above) and the energy conserving setting is activated. This automatic adjustment of the shades or curtains in accordance with room temperature either allows the room to be heated via entrance of sunlight when the unit 10 is cold, or prevents the room 10 from being heated by sunlight when the room 10 is hot. In this manner, a non-power consuming, temperature-controlling mechanism (i.e. sunlight) can be manipulated to keep the room 10 at an acceptable temperature.

When the energy conserving setting is activated via a maneuvering of the actuator 22, the setting may be then de-activated by again maneuvering the actuator 22. This second actuation of the actuator 22 returns the appliance control device 14 (and/or thermostat disposed therewith) to normal appliance settings that consume a normal amount of energy. This normal amount of energy consumption may be the level of energy consumption prior to activating the energy conserving setting, wherein the normal amount of energy consumption is more than the energy consumed when the energy conserving setting is activated. That is, the second actuation of the actuator 22 may return the appliance(s) 16 to an operating mode in which lesser energy conserving measures are taken or to a mode in which no energy conserving measures are employed. Additionally and/or alternatively, an additional actuation of the actuator 22 may enhance or increase the energy conserving setting to result in the appliance(s) 16 consuming less energy than under the original energy conserving setting.

The appliance control device 14 may be configured such that multiple consecutive depressions of the actuator 22 (such as three consecutive depressions) over a pre-determined period of time will result in a full shut down of all appliances included in the system 12.

Figure 6:
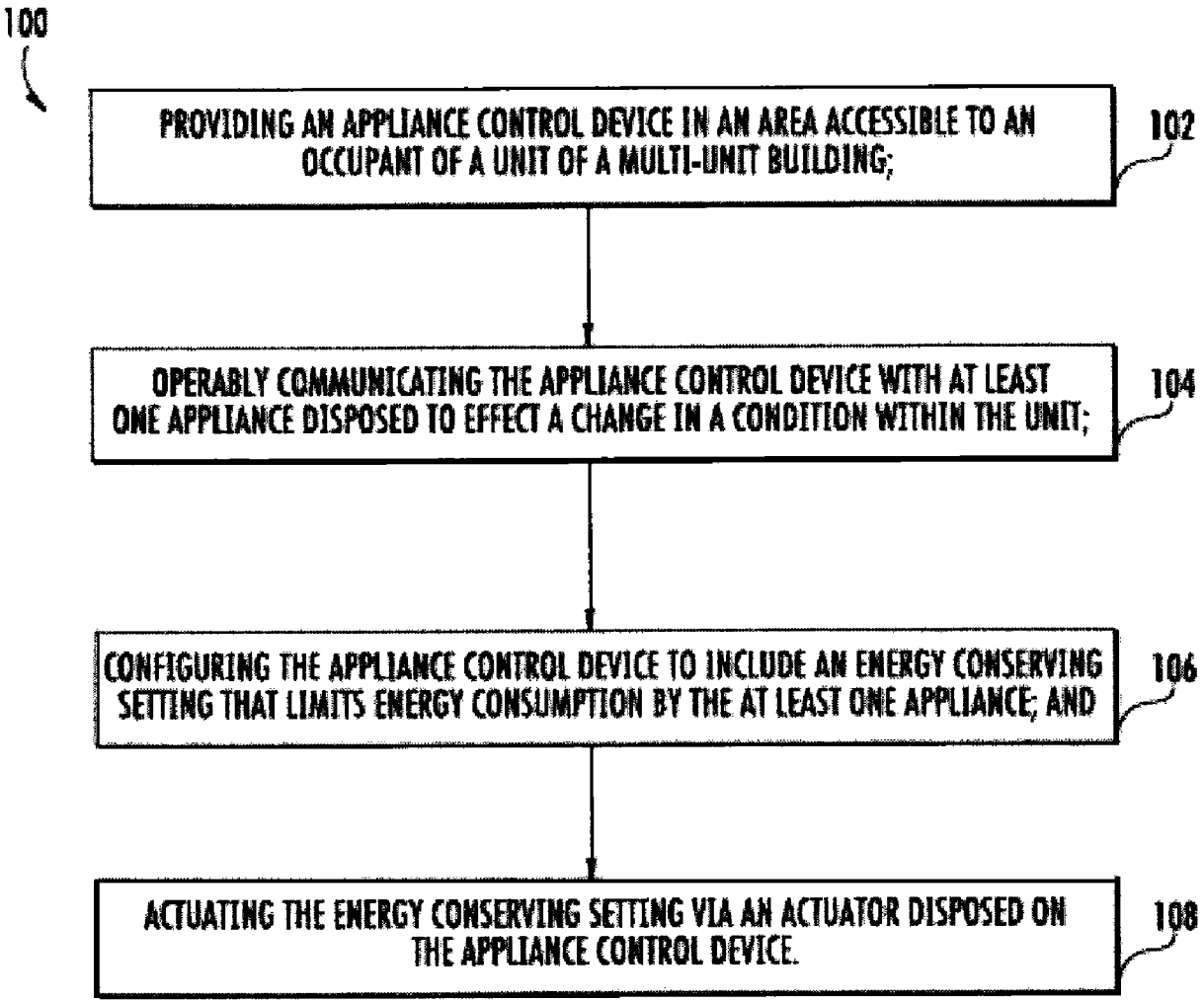
FIG. 6 is a block diagram illustrating a method for managing energy in a multi-unit building.

Referring to FIG. 6, there is disclosed a block diagram illustrating a method 100 for managing energy in a multi-unit building, the method including providing an appliance control device in an area accessible to an occupant of a unit of the building, as shown in operational block 102. The method 100 also includes operably communicating the appliance control device with at least one appliance disposed to effect a change in a condition within the unit (e.g., a change in room temperature), and configuring the appliance control device to include an energy conserving setting that limits energy consumption by the at least one appliance, as shown in operational blocks 104 and 106. The method 100 further includes actuating the energy conserving setting via an actuator disposed on the appliance control device, as shown in operational block 108. The actuator, as discussed above, is preferably a green push-button.

Herein, the appliance control device 14 is described as being configured to control the HVAC 18, the lighting 20, and/or the window covering mechanism 44 in order to provide reduced energy consumption within the exemplary room 10. The invention provides that the control device 14 may control one, some, or all of these room appliances. Additionally and/or alternatively, the control device 14 may be configured to control additional energy consuming arrangements within or associated with the room 10. For example, the control device 14 can control televisions, computers, monitor associated therewith, water pressure, water temperature. In this way, by selecting to maneuver the actuator 22, the occupant can experience energy conservation across numerous and varied in-room systems and arrangements.

The control device 14 may further be configured to alert the management of the multi-unit building when the occupant selects the energy conserving room settings. This alert may be provided by any suitable wired or wireless arrangement. Particularly, the control device can be disposed in communication with a network of the building. In this way, the management of the multi-unit building may monitor the energy usage within the room. Incentives or benefits may be given to the occupant by the management based upon the occupant's selected energy conservation settings. For example, the occupant may be provided with a reduced room rate or a credit at a local or in-building restaurant, spa, etc. Additionally and/or alternatively, based upon the occupant's in-room energy conservation, the management may provide information or data to the occupant concerning general or specific conservation efforts of the hotel, or the management may notify other hotel conservation programs with regard to the occupant's chosen reduced energy usage. For example, housekeeping may be notified with respect to common towel and linen recycling programs.

As mentioned, the control device 14 can be connected to and disposed in communication with a network of the multi-unit building. This may be achieved by any suitable wired or wireless means. This building network includes a controller for central monitoring and management of the multiple units. In addition to the benefits discussed in the previous paragraph, this type of centrally controlled environment allows the building management to reset the actuator 22 upon departure of the occupant such that the appliances 16 function in the normal operating mode. Also, via the central control arrangement, the building management may remotely adjust or disable the energy conserving settings based upon management requirements or based upon occupant requests, etc. For example, the building management may adjust the temperature range of the energy conserving setting of one or more rooms from the front desk or from an office within the building.

The system of the invention may further include one or more outdoor temperature sensors disposed in communication with the control device 14 and/or with the building network and controller. In this way, when the energy conserving setting is selected by the unit occupant, the control device 14 may further optimize energy conservation within the room by appropriately adjusting the window treatments, the room temperature, etc. based upon the detected outdoor temperature.

As mentioned, the units of the multi-unit building may include occupant sensors. These sensors may be disposed in communication with the control device 14 by wired or wireless means. Additionally and/or alternatively, the occupancy sensors may be disposed in communication with the building network and controller in order to facilitate the above-discussed centrally controlled environment functions.

While the control device 14 has been described herein as comprising a single actuator 22 (preferably a green push-button) for controlling one or more room appliances 16, the control device 14 may optionally include a plurality of actuators 22 each configured to allow occupant control of one or more room appliances 16. For example, the control device may include a first actuator related to the HVAC 18 and lighting 20, and a second actuator related to the window covering mechanism 44, a telephone or a television. The first and second actuators may be distinguishable having different colors, shapes, sizes, or by being labeled with text or numbers. In one embodiment, the first and second actuators are both green in color and are distinguished by shape, size, or labeling. Alternatively, a unit of the multi-unit building may include multiple control devices 14 where each device 14 is configured to communicate with and control common room appliances 16. For example, a first green button actuator 22 (as described above) may be disposed on a room thermostat (i.e., a first control device 16) and a second green button actuator 22 may be disposed on an in-room control panel such as the "IR3035 Table-Top Control Panel" provided by Inncom, Inc. (i.e., a second control device 16). Alternatively, the green button actuator might be part of on the TV or Phone appliance as a physical button and indicator or rendered through a display (such as an LCD) and a touch screen. Actuation of either the first or second green buttons would activate the applicable energy conservation room settings to regulate the operation of the room appliances.

Herein, the multi-unit building has primarily been described as a dwelling building such as a hotel, inn, dormitory, etc. However, the multi-unit building further comprises an office building with individual offices or units therein, each having an applicant control device as discussed herein. The multi-unit building may alternatively comprise a retail center with individual shops or units, each including the appliance control device. It will be understood that the unit 10 discussed herein comprises any definable section of a building including a room, an office, a wing of a building, a bank of offices, common space, seating area, a retail shop or shops, etc., or anywhere where indoor energy conservation is desired.

Generally, this disclosure provides a system for allowing an occupant of a single unit of a multi-unit building to select an operating state of the unit which consumes less energy than a normal operating state. The disclosure also pertains to a method of operating or managing a multi-unit building which involves informing an occupant upon arrival at the multi-unit building of an environmental effect of the occupant controlled energy management system provided in each of the individual units, encouraging the occupant to maneuver the actuator described above to accept the energy conservation room settings, providing reduced energy consumption within the unit upon the occupant's actuation of the actuator, and then optionally providing further information and/or benefits to the occupant having selected and utilized the reduced energy consumption setting.

Figure 7:
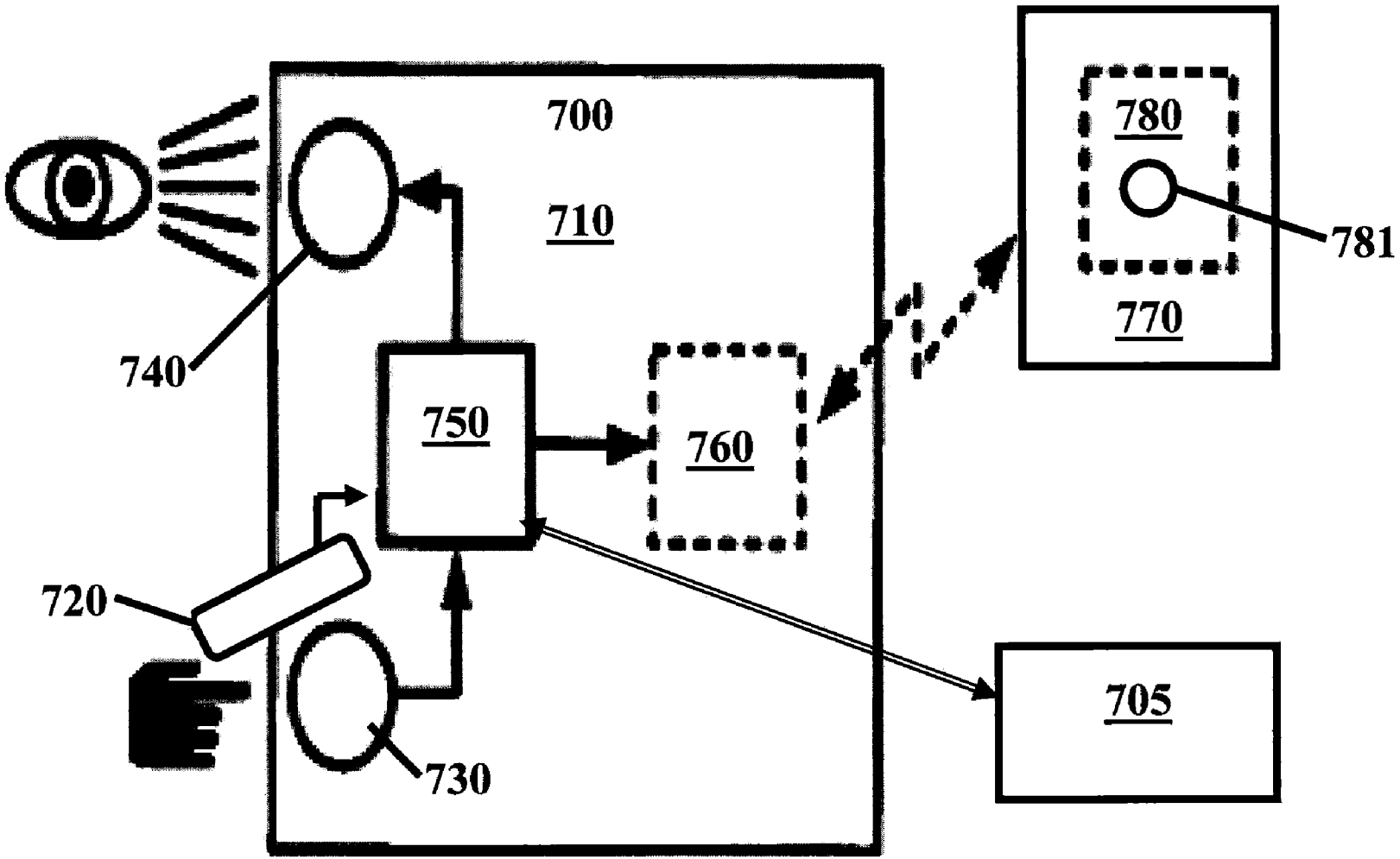
FIG. 7 is a schematic diagram of an apparatus by which an occupant of a unit can initiate am energy conservation mode in accordance with embodiments of the invention.

With reference now to FIG. 7, in accordance with another aspect of the invention, a system 700 is provided by which an occupant of a unit of a multi-unit building, such as a hotel, controls an appliance 705, which is operative in first (i.e., normal) and second (i.e., energy conserving) modes, and which effects a change in a condition of the unit in both the normal and the energy conserving modes. As described above, the appliance 705 could include any one or more of a heating, ventilating and air-conditioning (HVAC) unit, a hot water heating unit, a lighting fixture or a window shade controller.

When the appliance 705 is operative in the normal mode, the appliance 705 draws a certain amount of energy (i.e., electricity) from a power source to which it is connected. Conversely, when the appliance 705 is operative in the energy conserving mode, the appliance 705 draws a limited amount of energy from the power source. In accordance with embodiments of the invention, the limited amount of energy drawn by the appliance 705 is generally less than the amount drawn during normal mode operations.

As shown in FIG. 7, the system 700 includes a housing 710 disposed to be accessible to the occupant. The housing 710 may take the form of a standard in-room thermostat which is wall-mounted in the unit at a height that can be reached by most adults but need not be limited as such and may in fact not even be disposed within the unit.

A first actuator 720 may be supported on the housing 710 and may be provided to be in signal communication with the appliance 705 by way of a processing unit 750, which will be described below. An actuation of the first actuator 720 serves to control operations of the appliance 705 when the appliance 705 operates in the normal mode. That is, where the appliance 705 is, e.g., an HVAC unit, the first actuator 720 may be seen as a device, such as a thermostat cantilever, a thermostat rotary or a set of thermostat digital input buttons, by which the occupant may input a desired temperature setting for the unit. The input is then transmitted to the appliance 705, by way of the processing unit 750 in accordance with known methods, which is then controlled to comply with the input by preventing the unit temperature from deviating from the desired temperature by a preselected range.

A second actuator 730 may also be supported on the housing 710 and is also provided to be in signal communication with the appliance 705 by way of the processing unit 750. An actuation of the second actuator 730 by the occupant changes the operational mode of the appliance 705. Thus, if the appliance 705 is currently operative in the normal mode, following an actuation of the second actuator 730, the appliance 705 would be made to be operative in the energy conserving mode and vice versa.

An indicator 740 is disposed on the housing and is coupled to the processing unit 750. In this way, the indicator 740 is configured to sense when the appliance 705 is operative in the energy conserving mode. The indicator 740 is further configured to indicate that this is the case to the occupant, as a reminder, or to some other individual. To this end, it is understood that the indicator 740 may include an LED or some other suitable light source.

As is described above, as an example, if the unit were a room of a hotel, the indicator 740, when activated, could serve to put the in-unit staff (i.e., cleaning staff) services of the hotel and, in some cases, the managing staff (i.e., front desk staff) of the hotel on notice that the occupant, as a guest of the hotel, desires that the appliance 705 be operative in the energy conserving mode. The in-unit and managing staff could then take appropriate measures to honor the expressed desires of the occupant.

The limited amount of energy drawn by the appliance 705 when the appliance 705 is operative in the energy conserving mode is generally a function of the fact that the appliance 705 is operated according to a preselected energy conserving schedule that is defined and controlled by the processing unit 750, which is disposed within the housing 710 and which is provided to be in signal communication with the appliance 705 along with the features described above. The processing unit 750 may include storage capacity on which instructions are stored that define operations for the appliance 705, operative in the normal and the energy conserving modes, which are associated with respective actuations of the first and second actuators 720 and 730.

That is, where the appliance 705 is an HVAC unit, the instructions may stipulate that, when the HVAC unit is in the normal mode and the occupant inputs a desired temperature of the unit as being 72° F. on a 90° F. day, the HVAC unit is to maintain the unit temperature within a range of 71-73° F. On the other hand, if the occupant on the same day indicates that he wants the HVAC unit to operate in the energy conserving mode, the instructions may stipulate that the unit temperature target be 80° F. and within a range of 79-85° F. such that the HVAC unit generally consumes less energy that it otherwise would.

As mentioned above, the appliance 705 may include the storage capacity on which instructions are stored that define operations for the appliance 705, operative in the normal and the energy conserving modes, which are associated with respective actuations of the first and second actuators 720 and 730. In this case, the processing unit 750 merely informs the appliance 705 as to which of the normal and energy conserving modes to activate.

In an additional embodiment, if on the same day the user inputs a desired unit temperature that is actually higher than the unit temperature target, the processing unit 750 may judge that the HVAC unit would consume less energy by remaining in the normal mode as opposed to the energy conserving mode. In this case, the processing unit 750 may override any subsequent mode change from the normal mode to the energy conserving mode requested by the occupant.

In accordance with embodiments of the invention, the indicator 740 may be singular and provided on the housing 710 or otherwise within the unit. Alternately, the indicator 740 may be plural in number with an indicator provided in the unit and another indicator provided exterior to the unit. Where an indicator is provided exterior to the unit, and the unit is part of a multi-unit building, the exterior indicator 781 may be disposed at a main control unit 770 of the multi-unit building, such as a front desk or a central computer. In this case, the system 700 may further include a networking unit 760, such as a communications transceiver, coupled to the processing unit 750, by which the processing unit 750 communicates with a remote device 780, such as a receiver, of the main control unit 770. These communications may include data reflective of the current operational mode of the appliance 705. That is, the networking unit 760 may be configured to inform the main control unit 770 when the appliance 705 is operative in the energy conserving mode.

With communications between the networking unit 760 and the main control unit 770 established and the exterior indicator 781 activated, the managing staff of the multi-unit building may be informed as to when the appliance 705 is operative in the energy conserving mode. Thus, it is seen that the managing staff can insure that cost savings realized as a result of the appliance 705 being operative in the energy conserving mode may be transferred to the occupant. For example, for an occupant living in a hotel for two days, if the occupant actuates the second actuator 730 such that the appliance 705 is operative in the energy conserving mode for those two days, the hotel may provide a discount on the room rate to the occupant upon check. In this way, the occupant is given a motivation to maintain the appliance 705 in the energy conserving mode. In addition, the managing staff can further modify services to the occupant that comport with the occupant's indication that he values energy conservation. Such services can include laundry services, food services, etc. To an extent that in-room staff are not informed as to the occupant's indication, the indicator 740 may alert the in-room staff to modify in-room services accordingly, as noted above.

Where the processing unit 750 overrides a mode change requested by the occupant, it is understood that the indicator 740 may still be activated. Likewise, the cost savings associated with the relatively low energy demand of the occupant may also still be transferred to the occupant as described above.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A system for use in a multi-unit building by which an occupant of a unit of the multi-unit building controls an appliance associated with the unit, the system comprising:

an actuator which is accessible to the occupant;

a processing unit to control the appliance, operative in a first mode, based on occupant instructions, to change the mode of the appliance based on an actuation of the actuator and to control the appliance, operative in a second mode, according to a preselected schedule;

a networking unit to inform, via communications, a monitor of the multi-unit building as to when the appliance operates in the second mode; and an exterior indicator, external from the unit and coupled to the monitor, which activates in response to the networking unit informing the monitor as to when the appliance operates in the second mode and instructs managing staff of the multi-unit building to modify service to the occupant.

2. The system according to claim 1, wherein the appliance is configured to consume less energy when operating in the second mode as compared to the first mode.

3. The system according to claim 2, wherein the processing unit is configured to override a mode change from the first mode to the second mode in an event the appliance consumes less energy when operating in the first mode as compared to the second mode.

4. The system according to claim 1, further comprising an in-unit indicator, disposed in the unit, which activates when the appliance operates in the second mode.

5. The system according to claim 4, wherein the in-unit indicator informs the occupant as to when the appliance operates in the second mode.

6. The system according to claim 4, wherein the in-unit indicator instructs unit cleaning staff of the multi-unit building to modify service to the occupant.

7. The system according to claim 1, wherein the monitor is provided at a control unit of the multi-unit building and is configured to transfer to the occupant cost savings realized by the multi-unit building which are associated with the appliance operating in the second mode.

8. A system for use in a multi-unit building by which an occupant of a unit of the multi-unit building controls an appliance associated with the unit, the system comprising:

an actuator which is accessible to the occupant;

a processing unit to control the appliance, operative in a first mode, based on occupant instructions, to change the mode of the appliance based on an actuation of the actuator and to control the appliance, operative in a second mode, according to a preselected schedule;

a networking unit to transmit a signal that is reflective of the appliance operating in the second mode; and a monitor of the multi-unit building to receive the signal transmitted by the networking unit, the monitor being configured to calculate a total time during which the appliance operates in the second mode and to provide for compensation directed to the occupant in accordance with the calculated total time.

9. A system for use in a multi-unit building by which an occupant of a unit of the multi-unit building controls an appliance associated with the unit, the system comprising:

an actuator which is accessible to and willfully actuatable by the occupant by way of physical contact between the occupant and the actuator;

a processing unit to control the appliance, operative in a first mode, based on occupant instructions expressed through a willful physical contact actuation of the actuator by the occupant, to change the mode of the appliance based on a further willful physical contact actuation of the actuator by the occupant and to control the appliance, operative in a second mode, according to a preselected schedule; and a networking unit to inform, via communications, a monitor of the multi-unit building as to when the appliance operates in the first or the second mode.

* * * * *

UNITED STATES PATENT AND TRADEMARK OFFICE

CERTIFICATE OF CORRECTION

PATENT NO. : 7,643,908 B2
APPLICATION NO. : 12/274431
DATED : January 5, 2010
INVENTOR(S) : Richard N. Quirino et al.

It is certified that error appears in the above-identified patent and that said Letters Patent is hereby corrected as shown below:

On the Title Page Item (56)
Under Other Publications the Patent reads:

Control4 Suite Systems, Redefining the Guest Experience; Control4 Everyday Easy; Informational Brochure; Control4 11734 S. Election Road, Salt Lake City, Utah 84020 control4.com/suitesystems; Copyright "2006"; 6 pages.

But the Patent should read:

Control4 SuiteSystems, Redefining the Guest Experience; Control4 Everyday Easy; Informational Brochure; Control4 11734 S. Election Road, Salt Lake City, Utah 84020 control4.com/suitesystems; Copyright --2008--; 6 pages.

Signed and Sealed this

Sixteenth Day of February, 2010

David J. Kappos

David J. Kappos
*Director of the United States Patent and Trademark Office*